United States Patent [19]

Eck

[11] Patent Number: 4,586,768

[45] Date of Patent: May 6, 1986

[54] ELECTRICAL CONNECTOR PLUG WITH AN INTEGRAL EJECTOR

[75] Inventor: Bertil Eck, Warrington, Pa.

[73] Assignee: Honeywell Inc., Minneapolis, Minn.

[21] Appl. No.: 609,904

[22] Filed: May 11, 1984

[51] Int. Cl.[4] ..... H01R 13/62

[52] U.S. Cl. ..... 339/45 M; 339/103 M

[58] Field of Search ..... 339/45, 108 R, 108 TP, 339/110 P, 110 R, 104, 103 R, 103 M

[56] References Cited

U.S. PATENT DOCUMENTS

| | | | |
|---|---|---|---|
| 3,152,219 | 10/1964 | Murray et al. | 339/104 |
| 3,245,024 | 4/1966 | Evans | 339/103 M |
| 3,772,635 | 11/1973 | Frey et al. | 339/108 R |
| 3,966,293 | 6/1976 | Mathe et al. | 339/103 R |
| 3,997,234 | 12/1976 | Worman | 339/108 R |
| 4,005,921 | 1/1977 | Hadden et al. | 339/103 R |
| 4,111,512 | 9/1978 | Parmer et al. | 339/103 M |
| 4,488,769 | 12/1984 | Feigl | 339/103 M |

*Primary Examiner*—Gil Weidenfeld
*Assistant Examiner*—David L. Pirlot
*Attorney, Agent, or Firm*—Mitchell J. Halista; Trevor B. Joike

[57] ABSTRACT

An electrical connector plug ejector apparatus includes a cogged belt having transverse teeth arranged to mesh with transverse surface grooves on an electrical connector plug. A snap-on cover is arranged to retain the belt to the surface of the plug with the teeth of the belt meshing with the plug grooves and the ends of the belt retained beneath the cover to form the belt into an endless loop above the connector. External electrical connections to the connector are provided by individual wires positioned in respective plug surface channels forming extensions of the grooves and arranged to exit beneath the edge of the cover. The belt provides a flexible handle for ejecting the plug from an associated socket while providing a strain relief for the electrical connections by transferring a retaining force for the belt supplied by the cover to the electrical connecting wires.

5 Claims, 3 Drawing Figures

ELECTRICAL CONNECTOR PLUG WITH AN INTEGRAL EJECTOR

BACKGROUND OF THE INVENTION

1. Field of the Invention

The present invention is directed to electrical connector plugs. More specifically, the present invention is directed to integral ejector means for ejecting the connector plug from a socket.

SUMMARY OF THE INVENTION

An object of the present invention is to provide an improved electrical connector plug ejector.

In accomplishing this and other objects, there has been provided, in accordance with the present invention, an ejector apparatus including a connector plug having a plurality of spaced grooves on a face thereof, a cover means attached to said plug to cover said face of said plug, and a toothed belt means retained by said cover means on said face of said plug with a plurality of the teeth of said belt means being located in corresponding ones of said grooves.

BRIEF DESCRIPTION OF THE DRAWINGS

A better understanding of the present invention may be had when the following detailed description is read in connection with the accompanying drawings in which.

DESCRIPTION OF THE PREFERRED EMBODIMENT

Detailed Description

Figure 1:
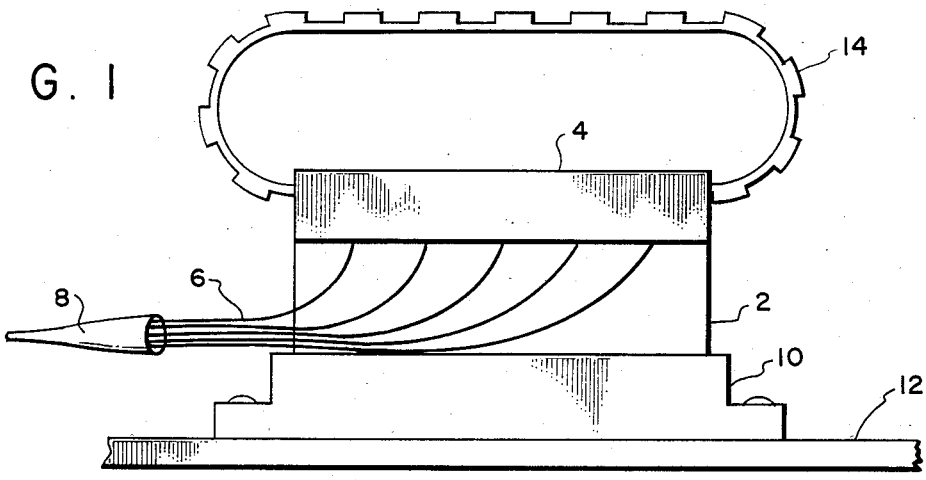
FIG. 1 is a pictorial illustration of a side view of an assembled connector plug utilizing an embodiment of the present invention.

Referring to FIG. 1 in more detail, there is shown a connector plug 2 having a cover 4, e.g., a so-called IDC Type Connector plug manufactured by several manufacturers in various sizes and connection capability. A plurality of electrical wires 6 emanating from a wire cable 8 are each electrically connected to the plug 2. The plug 2 is plugged into a socket 10 mounted on a mounting panel 12, e.g., a printed circuit board. A cogged or toothed belt 14 is attached to the plug 2 by the cover 4 to provide a means for ejecting the plug 2 from the socket 10.

Figure 2:
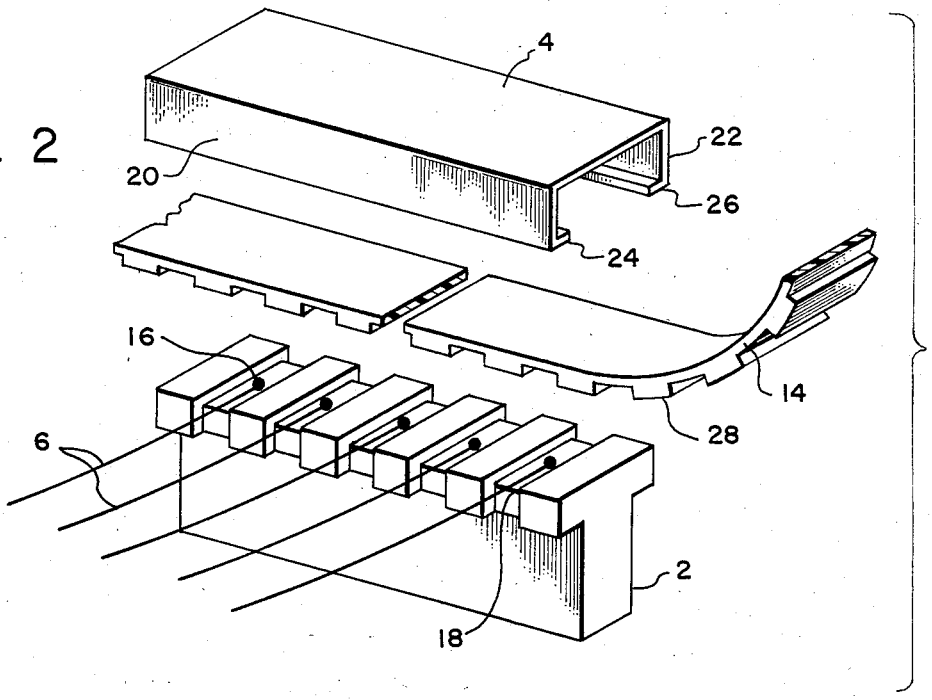
FIG. 2 is an exploded pictorial representation of a connector plug embodying the present invention and FIG. 3 is a cross-sectional side view of an assembled connector plug shown in FIG. 2.

In FIG. 2, there is shown an exploded pictorial illustration of the connector plug shown in FIG. 1 embodying the present invention and utilizing the same reference numbers used in FIG. 1 for similar elements. Thus, the connecting wires 6 are connected to electrical connections 16 within transverse grooves 18 positioned across an end face of the plug 2. The cover 4 is made of flexible material and is arranged to snap-on the plug 2 by having the plug 2 formed with a T-cross section with the top bar of the T mating with an interior of the cover 4. The cover 4 has an interior space defined by a cover top 21 and parallel side walls 20, 22 with spaced apart longitudinal inwardly facing ledges 24, 26 located along the ends of side walls 20,22 respectively. Thus, the cover 4 can be snapped on the plug 2 by forcing apart the ledges 24,26 to enable the top bar of the T to enter the interior space of the cover 4. The toothed belt 14 has transverse teeth 28 thereon with a spacing between the teeth equal to the spacing of the transverse grooves 18 on the plug 2. The ends 14*a*, 14*b* of the belt 14 are butted together beneath the cover 4 which retains the belt 14 against the plug 4. On the other hand, the belt 14 may be of an endless loop construction, i.e., a timing belt, with a suitable overall length.

Figure 3:
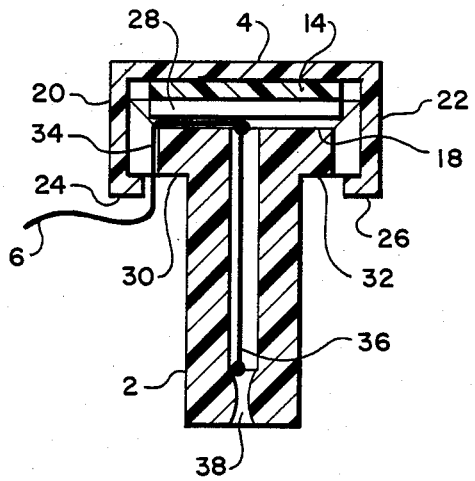

In FIG. 3, there is shown a cross-sectional view of an assembled connector 2 having the cover 4 mounted thereon with the ledges 24 and 26 engaging the outer surface of the ears 30 and 32 of the outwardly projecting ends of the top bar of the T cross section of the plug 2. In order to accommodate the wires 6, a plurality of wire channels 34 may be provided on the end of one of the ears 30, 32 communicating with respective ones of the grooves 18 to allow the wires 6 to pass beneath the adjacent longitudinal edge of the cover 4. Each of the wires 6 is connected to a corresponding one of a plurality electrical conductors 36 located within the plug 2 for providing an electrical connection between the wires 6 and a respective socket engaging electrical contact 38 located in the end of the plug 2. Thus, when the cover 4 is snapped on the plug 2, the belt 14 is retained beneath the cover 4 with the teeth of the belt 14 meshing with the grooves 18 in the plug 2. Further, the belt 14 is arranged as an endless loop above the plug 2 to provide a flexible handle for ejecting the plug from the socket 10. The teeth of the belt 14 assist in retaining the ends of the wires 6 against the electrical connections 16 while the cover 4 provides a strain relief for the connections 16 by having the wire 6 bearing against the locked-on cover 4 through the belt 14.

Accordingly, it may be seen, that there has been provided, in accordance with the present invention, an improved electrical connector plug ejector.

The embodiments of the present invention in which an exclusive proper or privilege is claimed are defined as follows:

1. An ejector apparatus comprising a connector plug having a plurality of spaced grooves on a face thereof, a cover means attached to said plug to cover said face of said plug, and a toothed belt means retained by said cover means on said face of said plug with a plurality of the teeth of said belt means being located in corresponding ones of said grooves, said belt means comprising a belt segment having a first end and a second end arranged with said ends butted together beneath said cover means and said belt forming an endless loop external to said cover means.

2. An apparatus as set forth in claim 1 wherein said teeth of said belt means have the same tooth spacing as said grooves in said plug.

3. An apparatus as set forth in claim 1 wherein said plug includes a pair of longitudinal ears and said cover means includes a pair of inwardly facing longitudinal ledges arranged to grip said ears when said cover means is attached to said plug.

4. An apparatus as set forth in claim 1 wherein said plug means includes a plurality of electrical connectors with each of said connectors being located in a respective one of said grooves.

5. An apparatus as set forth in claim 3 wherein each of the grooves includes an extension channel located on a second face of said plug adjacent to said first-mentioned face and extending past the longitudinal ears of said cover means in an attached position of said cover means on said plug.

* * * * *